US009698002B2

(12) United States Patent
Hauschild et al.

(10) Patent No.: US 9,698,002 B2
(45) Date of Patent: Jul. 4, 2017

(54) METHOD AND APPARATUS FOR MASS ANALYSIS UTILIZING ION CHARGE FEEDBACK

(71) Applicant: Thermo Fisher Scientific (Bremen) GmbH, Bremen (DE)

(72) Inventors: Jan-Peter Hauschild, Bremen (DE); Oliver Lange, Bremen (DE); Ulf Fröhlich, Bremen (DE); Andreas Wieghaus, Bremen (DE); Alexander Kholomeev, Bremen (DE); Alexander Makarov, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 15/131,117

(22) Filed: Apr. 18, 2016

(65) Prior Publication Data

US 2016/0233078 A1 Aug. 11, 2016

Related U.S. Application Data

(63) Continuation of application No. 14/114,898, filed as application No. PCT/EP2012/059299 on May 18, 2012, now Pat. No. 9,324,547.

(30) Foreign Application Priority Data

May 20, 2011 (GB) ..... 1108473.8

(51) Int. Cl.
*H01J 49/04* (2006.01)
*H01J 49/00* (2006.01)
(Continued)

(52) U.S. Cl.
CPC ..... *H01J 49/4265* (2013.01); *H01J 49/0031* (2013.01); *H01J 49/04* (2013.01);
(Continued)

(58) Field of Classification Search
CPC ..... H01J 49/4265; H01J 49/38; H01J 49/425; H01J 49/04; H01J 49/0031; H01J 49/4245; H01J 49/42; H01J 49/009
See application file for complete search history.

(56) References Cited

U.S. PATENT DOCUMENTS 6,555,814 B1 4/2003 Baykut et al.
6,982,413 B2 1/2006 Knecht et al.
(Continued)

FOREIGN PATENT DOCUMENTS

CN 101627455 A 1/2010
EP 1298700 A2 4/2003

OTHER PUBLICATIONS

Hardman, et al., "Interfacing the Orbitrap Mass Analyzer to an Electrospray Ion Source," Anal. Chem. , vol. 75 (No. 7), 2003, pp. 1699-1705.

*Primary Examiner* — Nicole Ippolito
*Assistant Examiner* — Sean Luck
(74) *Attorney, Agent, or Firm* — Charles B. Katz

(57) ABSTRACT

A method of mass analysis and a mass spectrometer are provided wherein a batch of ions is accumulated in a mass analyzer; the batch of ions accumulated in the mass analyzer is detected using image current detection to provide a detected signal; the number of ions in the batch of ions accumulated in the mass analyzer is controlled using an algorithm based on a previous detected signal obtained using image current detection from a previous batch of ions accumulated in the mass analyzer; wherein one or more parameters of the algorithm are adjusted based on a measurement of ion current or charge obtained using an independent detector located outside of the mass analyzer.

22 Claims, 4 Drawing Sheets

(51) Int. Cl.
*H01J 49/38* (2006.01)
*H01J 49/42* (2006.01)

(52) U.S. Cl.
CPC ..... *H01J 49/38* (2013.01); *H01J 49/425* (2013.01); *H01J 49/4245* (2013.01)

(56) References Cited

U.S. PATENT DOCUMENTS

| | | | | |
|---|---|---|---|---|
| 7,047,144 | B2 | 5/2006 | Steiner | |
| 7,482,581 | B2 | 1/2009 | Lange et al. | |
| 2005/0080571 | A1 | 4/2005 | Klee | |
| 2005/0080578 | A1 | 4/2005 | Klee | |
| 2007/0023630 | A1 | 2/2007 | Malek et al. | |
| 2007/0143319 | A1 | 6/2007 | Malek et al. | |
| 2007/0203652 | A1 | 8/2007 | Horning et al. | |
| 2008/0191129 | A1 | 8/2008 | Makarov et al. | |
| 2008/0203288 | A1 | 8/2008 | Makarov et al. | |
| 2009/0045816 | A1 | 2/2009 | Robinson | |
| 2009/0166528 | A1 | 7/2009 | Makarov | |
| 2010/0096545 | A1 | 4/2010 | Malek et al. | |
| 2010/0181475 | A1 | 7/2010 | Makarov et al. | |
| 2010/0193680 | A1 | 8/2010 | Makarov et al. | |
| 2010/0314538 | A1* | 12/2010 | Makarov ..... | H01J 49/425 250/283 |
| 2011/0240841 | A1 | 10/2011 | Lange | |

* cited by examiner

METHOD AND APPARATUS FOR MASS ANALYSIS UTILIZING ION CHARGE FEEDBACK

CROSS-REFERENCE TO RELATED APPLICATIONS

The present application is a continuation under 35 U.S.C. §120 and claims the priority benefit of co-pending U.S. patent application Ser. No. 14/114,898, filed Oct. 30, 2013, which is a National State application under 35 U.S.C. §371 of PCT Application No. PCT/EP2012/059299, filed May 18, 2012, claiming priority to GB1108473.8, filed May 20, 2011. The disclosures of each of the foregoing applications are incorporated herein by reference.

FIELD OF THE INVENTION

The present invention relates to the field of mass spectrometry and in particular mass spectrometry employing image current detection of ions, such as FT mass spectrometry using FT-ICR cells and electrostatic traps, including electrostatic orbital traps.

BACKGROUND OF THE INVENTION

Numerous types of mass spectrometer employ image current detection of ions Such spectrometers commonly employ Fourier transformation of the detected image current to produce the frequency and/or mass spectrum, hence giving rise to the name Fourier transform mass spectrometry (FTMS). Such mass spectrometers typically employ ion trapping devices, with which there is a need to control the ion population in the ion trap in order to limit space charge effects.

Clearly, it is desirable in FTMS to accumulate as many ions as possible in the mass analyser, in order to improve the statistics of the collected data. However, this is in conflict with the fact that there is saturation at higher ion concentrations caused by space charge effects. These space charge effects limit mass resolution and affect the mass accuracy, leading to incorrect assignment of masses and even intensities.

The total ion abundance accumulated within an ion trap may be controlled by automatic gain control (AGC) as described in detail in U.S. Pat. No. 5,107,109 and WO 2005/093782 for RF linear traps. First, ions are accumulated over a known time period and a rapid total ion abundance measurement is performed. Knowledge of the time period and the total ion abundance in the trap allows selection of an appropriate filling time for subsequent ion fills to create an optimum ion abundance in the trap.

There have been proposed a number of further ways to control ion population within the trap. For example, for RF ion traps as described in U.S. Pat. No. 5,572,022 and U.S. Pat. No. 6,600,154 it has been proposed to include a pre-scan just before the analytical scan in order to provide a feedback for automatically controlling the gating or fill time for introducing ions into the trap for the analytical scan. It has also been proposed to use an extrapolation of a multitude of pre-scans as in U.S. Pat. No. 5,559,325 for a similar purpose. In another method, disclosed in WO 03/019614, there has been proposed the use of an electrometer type detector of a triple quadrupole arrangement to measure the ion flux in transmission mode for determining fill times of subsequent analytical scans. In the case of FT-ICR, a method has been proposed in U.S. Pat. No. 6,555,814 which includes pre-trapping ions in an external accumulation device with subsequent detection on an electron multiplier.

In the case of FTMS, the instrument can be configured to use image current detection for determination of ion charge into the mass analyser. The ions are typically first trapped in an injection device, such as a linear trap, before transfer to the FT mass analyser and the ion current determined in the mass analyser can be used so that the ion number in the injection device is controlled to avoid space charge effects therein. For example, this approach is used in numerous Orbitrap™ electrostatic trap instruments from Thermo Fisher Scientific, in some cases along with automatic gain control (AGC) in the interfaced linear trap, where a short duration pre-scan ("AGC pre-scan") is used for the estimation of ion currents.

It is desirable to improve the accuracy of ion number measurements in FTMS, especially using image current detection.

SUMMARY OF THE INVENTION

Against this background, the present invention in one aspect provides a method of mass analysis comprising:

accumulating a batch of ions in a mass analyser;

detecting the batch of ions accumulated in the mass analyser using image current detection to provide a detected signal;

wherein the method comprises controlling the number of ions in the batch of ions accumulated in the mass analyser using an algorithm based on a previous detected signal obtained using image current detection from a previous batch of ions accumulated in the mass analyser; and wherein the method comprises adjusting one or more parameters of the algorithm based on a measurement of ion current or charge obtained using an independent detector located outside of the mass analyser.

The present invention in another aspect provides a mass spectrometer comprising:

a mass analyser comprising detection electrodes for detecting a signal from a batch of ions accumulated in the analyser using image current detection;

an independent detector located outside of the mass analyser for measuring an ion current of ions which have not been injected into the mass analyser; and a control arrangement operable to control the number of ions in the batch of ions accumulated in the mass analyser using an algorithm based on a previous detected signal obtained using image current detection from a previous batch of ions accumulated in the mass analyser, wherein one or more parameters of the algorithm are adjustable based on a measurement of ion current or charge obtained using the independent detector. The mass spectrometer preferably comprises an injection device for injecting ions into the mass analyser to accumulate the batch of ions in the mass analyser;

The present invention in still another aspect provides a method of determining the total charge of ions stored in a mass analyser comprising:

accumulating a batch of ions in the analyser;

detecting the batch of ions accumulated in the analyser using image current detection to provide a detected signal; and determining the total charge of ions in the batch of ions accumulated in the analyser based on the detected signal obtained using image current detection;

wherein the method comprises adjusting the determined total charge of ions based on a measurement of ion current or charge obtained using an independent detector located outside of the analyser.

The invention is designed for application to mass analysers that use image current detection of ions therein, e.g. FTMS analysers. The image current detector needs to be calibrated in order to measure absolute numbers of ions in a pre-scan. This can be done indirectly by measuring saturation effects arising from saturation of the injection device, such as a linear trap, for injecting ions into the FT analyser, as the number of ions in the injection device is increased. For example, in the case of an Orbitrap™ FT mass analyser, the signal tends to increase slower and slower until it reaches saturation. Using these observed saturation effects, the instrument can be calibrated so that it operates in the linear measurement regime. This calibration is, however, dependent on the transmission and performance of the instrument, which is undesired. For example, it depends on the transmission from the linear trap to the Orbitrap analyser and the quality of gating the ion beam within the instrument, the linearity of the RF supply to the linear trap injection device and lens settings as well as other factors. It has been experimentally discovered that, although such calibration works in the majority of cases, there are situations when the pre-scan can give false results. For example, this can occur if the detected signal is rapidly decaying, or exhibiting a beat structure (e.g. for heavy proteins), or if an extremely complicated matrix is present with only a few intense peaks (as happens, for example, in the field of proteomics). Also, close neighbouring peaks in a low resolution pre-scan may interfere with each other. In such cases, an AGC pre-scan may not be capable of an accurate determination of the number of ions.

The invention enables the total charge (or total ion content) of a batch of ions stored in the mass analyser to be more accurately measured than using image current detection alone, e.g. it enables a previous detected signal obtained using image current detection from the mass analyser, which can be from either a short pre-scan or a full length analytical scan, to be used with greater accuracy for controlling the fill or injection time used in accumulating a subsequent batch of ions. The invention achieves this improvement in total ion charge determination by effectively adjusting the measurement from the image current detection using an absolute measurement of integrated ion current (total ion charge) from an independent detector such as a charge measuring device, from which can be obtained a more accurate determination of the total charge of the ions (hence total ion content) in the previous batch. The invention thus still uses the measurement from the image current detection, which for example contains useful mass spectral information, but the measurement is adjusted by using a more accurate measurement of ion current from an independent detector. Advantageously, the measurement by the independent detector may be performed occasionally, rather than for every analytical scan. The invention thus enables the ion content of subsequent batches of ions to be controlled using an enhanced automatic gain control (AGC). The invention implements the improvement by employing an algorithm to control the number of ions in a subsequent batch of ions accumulated in the mass analyser which is based on a previous detected signal obtained using image current detection in the mass analyser, wherein one or more parameters of the algorithm are adjusted based on a measurement of ion current or charge obtained using an independent detector.

The independent detector may additionally be employed for other beneficial uses in the mass spectrometer, such as optimization and diagnostic purposes, as described in more detail below.

The present invention relates to mass spectrometry employing image current detection of ions, such as FT mass spectrometry. The mass analyser therefore comprises detection electrodes to detect an image current induced by the oscillation of ions in the mass analyser. The invention particularly applies to mass analysers having a trapping volume therein in which the ions may be trapped and preferably oscillate with a frequency which depends on their mass-to-charge and which can be detected using image current detection. The mass analyser is typically a trapping mass analyser, especially an FT mass analyser, with preferred examples being FT-ICR cells and electrostatic traps, including, for example, electrostatic orbital traps. In more preferred embodiments, the mass analyser is an electrostatic orbital trap, wherein ions perform substantially harmonic oscillations along an axis in an electrostatic field whilst orbiting around an inner electrode aligned along the axis, such as an Orbitrap™ mass analyser from Thermo Fisher Scientific. Details of an Orbitrap™ mass analyser can be found in U.S. Pat. No. 5,886,346. The mass analyser is most preferably an electrostatic orbital trap having an inner electrode arranged along an axis and two outer detection electrodes spaced apart along the axis and surrounding the inner electrode. With such analysers, it has been found that the known use of a pre-scan for automatic gain control (AGC) in the analyser to determine the total ion charge can give false results. For example, although not being bound by any theory, it is believed that this can occur if the detected signal is rapidly decaying, or exhibiting a beat structure (e.g. for heavy proteins), or if an extremely complicated matrix is present with only a few intense peaks (as happens, for example, in the field of proteomics). In such cases, an AGC pre-scan may not be capable of an accurate determination of the number of ions. The present invention addresses this shortcoming.

In general, however, and without prejudice to the above, the mass analyser may be any analyser selected from the following group: an FT-ICR cell, an electrostatic trap (of open or closed type), an electrostatic orbital trap (such as an Orbitrap™ analyser) an RF ion trap (such as a 3D ion trap, or a linear ion trap), a time-of-flight (TOF) mass analyser etc.

The ions may be either positive ions or negative ions, and singly or multiply charged.

From the detected signal using image current detection in the mass analyser, a mass spectrum may thereby be obtained, typically using Fourier transformation. The invention preferably comprises controlling the number of ions, i.e. ion content, in a batch of ions which are accumulated in the mass analyser to obtain an analytical mass spectrum (analytical scan).

The invention comprises detecting the previous detected signal using image current detection for a given detection time (previous detection time or test injection time). The previous detection time may be substantially the same as (e.g. in the case where the previous detected signal is from a previous analytical scan), or often preferably less than (e.g. in the case where the previous detected signal is from a so-called short pre-scan), the detection time for detecting the batch of ions in the analytical scan. It is possible that in some cases the previous detection time is greater than the detection time for detecting the batch of ions in the analytical scan, e.g. when using a previous analytical scan to provide the previous detected signal and the previous analytical scan has a longer detection time than the subsequent analytical scan. Where the previous scan is itself an analytical scan then time may be saved by not performing a pre-scan.

The repetition rate of short pre-scans may be the same as or less than the repetition rate of analytical scans, typically the same. For example, a short pre-scan may be performed before each analytical scan.

Preferably, the previous detected signal used in the algorithm is the detected signal from the immediately preceding batch of ions in the mass analyser. For example, where a short pre-scan is used, a short pre-scan is carried out immediately before each analytical scan. This is useful when the conditions are changing rapidly as in fast chromatography, unstable ionisation or pulsed ion desorption methods for example.

In some embodiments, the invention may alternate between detecting a batch of ions using the image current detection in an analytical scan and detecting a batch of ions using the image current detection in a short pre-scan, wherein the method may use the algorithm to control the number of ions accumulated in the mass analyser for each analytical scan based on a previous short pre-scan (preferably, the immediately previous short pre-scan).

In some other embodiments, the invention may use the algorithm based on a previous analytical scan to control the number of ions accumulated in the mass analyser for a subsequent analytical scan.

In yet other embodiments, for some analytical scans the invention may use the algorithm based on a previous short pre-scan to control the number of ions accumulated in the mass analyser and for other analytical scans the method may use the algorithm based on a previous analytical scan to control the number of ions accumulated in the mass analyser.

The previous detected signal is preferably used to determine a total ion content (or ion number) of the ions in the previous batch in the analyser. The determined total ion content may then be used in the algorithm to control the number of ions subsequently accumulated in the mass analyser. Preferably, the previous detected signal and associated determined total ion content used in the algorithm are those from the immediately preceding batch of ions in the mass analyser.

The algorithm preferably determines settings for an injection device for injecting ions into the mass analyser. In particular, the algorithm preferably determines settings for controlling the number of ions stored in an injection device, the stored ions being for injection into the mass analyser. The control arrangement, which may comprise a computer, preferably controls the injection device and thus changes the settings for the injection device using the algorithm. The algorithm may determine an injection time (a target injection time) for injecting ions into the injection device and/or a target number of pulses of ions for injecting ions into the injection device, thereby to control the number of ions accumulated in the injection device and hence the number of ions subsequently accumulated in the mass analyser. The injection device filled with the controlled number of ions is typically subsequently emptied by injecting all the ions contained therein, preferably as a pulse, into the mass analyser. For certain types of mass spectrometer, the controlled injection time determined by the algorithm could be the time for injecting the ions into the mass analyser.

The algorithm, and thus target injection time and/or the number of pulses of ions injected into the injection device (or mass analyser), may be based on (i.e. the parameters of the algorithm may comprise): the previous detected signal obtained using image current detection in the mass analyser (especially a total ion content or charge determined therefrom), the known injection time and/or number of pulses of the previous batch of ions into the injection device (or mass analyser) and a desired or target maximum number of ions (hence a target total ion content or charge) in the injection device (or mass analyser). These quantities are generally related according to the equation:

$$IT_{Target}=(TIC_{Target}/TIC_{Pre})*IT_{Pre}$$

where $IT_{Target}$ is the target injection time and/or the number of pulses of ions for the target number of ions, $TIC_{Target}$ is the target total signal per unit time (total ion current or charge) for the target number of ions, $TIC_{Pre}$ is the total signal per unit time of the previous batch (e.g. from a pre-scan), and $IT_{Prev}$ is the known injection time and/or number of pulses of ions for the previous batch (e.g. pre-scan).

The desired or target maximum number of ions in the injection device (or mass analyser) is preferably below the number of ions which would cause significant space charge effects in the injection device (or mass analyser). The desired maximum number of ions in the injection device (or mass analyser) is preferably an optimum number of ions which improves the statistics of the collected data whilst avoiding space charge effects. Typically, the injection device has a lower space charge capacity than the mass analyser and it is the filling of the injection device which is to be controlled to avoid overfilling it. This is the case, for example, for an electrostatic orbital trap mass analyser with a curved linear trap (C-trap) as an injection device.

The algorithm comprises at least one parameter which can be adjusted based on the measurement of ion current or charge obtained from the independent detector. For example, the algorithm is preferably based on a modification of the above equation:

$$IT_{Target}=(TIC_{Target}/TIC_{Pre})*IT_{Pre}*C$$

where C is a calibration coefficient which is adjusted using the measurement from the independent detector. For instance, C is scaled according to the ratio of the total ion current or charge measured from the independent detector, $I_{Ind}$ to $TIC_{Pre}$, with C=1 for a calibration mixture. This coefficient could include also dependence on the target signal and parameters of the instrument.

The adjustment of the algorithm parameter(s) using the measurement of ion current or charge obtained from the independent detector preferably comprises a calibration for the previous detected signal obtained using image current detection. The adjustment of the one or more parameters of the algorithm, e.g. coefficient C in the equation above, may comprise scaling the previous detected signal (especially the total ion content determined therefrom). The adjustment of the one or more parameters of the algorithm may comprise scaling the total ion content determined from the previous detected signal by the ratio of the total ion content as determined from the independent detector to the total ion content as determined from the previous detected signal. Thus, the total ion content as determined from the independent detector is used to define a factor by which total ion content determination from the image current detection should be scaled up or down. Thus, the measurement of the previous detected signal and the measurement of ion current or charge obtained using the independent detector may each be used to determine the total ion content of the previous batch of ions in the mass analyser wherein the algorithm takes account of both measurements. Thus, unlike the method in WO 03/019614, an electrometer detector in the present invention is not used instead of a pre-scan prior to each analytical scan, but rather is employed, e.g. occasionally, to define a factor by which the total ion content determined from a scan using image current detection in FTMS may be scaled up or down.

The number of ions accumulated in the mass analyser may be controlled for a selected mass range. That is, the control arrangement may be operable to control the number of ions in the batch of ions accumulated in the mass analyser in a selected mass range. Thus, the total ion content may be determined for all the ions in the previous batch in the mass analyser, or only for ions in a selected mass range in the previous batch, e.g. using the mass spectral information in the detected signal. For example, peak intensities for mass peaks in the selected mass range derived from the detected signal can be used to determine the total content of ions in that mass range. Such information can be used to control the number of ions in the selected mass range injected into the mass analyser in a subsequent scan, especially where a mass selector upstream of the injection device is used to select only ions of the selected mass range for injection. For instance, the total ion charge or content determined from all the ions in the previous batch may be scaled by the ratio of the total peak intensities of ions in the selected mass range to the total peak intensities of all ions in the batch, thereby to obtain the ion content for ions in the selected mass range. Such a ratio may also be used to scale the total ion charge or content measured by the independent detector to obtain an absolute ion charge or content for the ions in the selected mass range, which can then be used for adjusting the one or more parameters in the algorithm.

The invention thus may comprise utilising mass spectral information from the previous detected signal. For example, the invention may comprise controlling the number of ions accumulated in the mass analyser in a selected mass range using an algorithm based on the total ion content of ions in the selected mass range determined from a previous detected signal; and adjusting one or more parameters of the algorithm based on a measurement of ion current or charge of ions in the selected mass range obtained using the independent detector. The selected mass range of ions may be selected by means of a mass selector located upstream of the mass analyser.

The invention may thus be used for tandem mass spectrometry, i.e. $MS^2$, or mass spectrometry with an even higher number of stages, i.e. $MS^n$. In such cases, using mass spectral information from a previous detected signal, the previous detected signal may be used in the algorithm to determine the target injection time and/or number of pulses to be injected for a limited selected mass range smaller than the total mass range of ions in the previous batch. For example, a smaller mass range of ions may be desired for a subsequent scan, based on analysis of a previous wider or full mass scan, such as for fragmenting the selected smaller mass range ions in a collision or reaction cell before analysing the fragment ions in the mass analyser in the subsequent scan.

Advantageously, the frequency of measurement of ion current or charge using the independent detector may be less than the frequency of obtaining detected signals from batches of ions in the mass analyser. However, it is possible to perform measurements of the ion current or charge using the independent detector with the same or comparable frequency as the frequency of obtaining detected signals from batches of ions in the mass analyser, e.g. of analytical scans. Typically, measurements of the ion current or charge using the independent detector are made occasionally, i.e. less frequently than obtaining detected signals from batches of ions in the mass analyser. The independent detector may, for example, be used with a period between measurements corresponding to a typical time of content change in complex mixtures, preferably every 1 to 10, more preferably every 2 to 10 seconds. Preferably, the measurement of ion current or charge using the independent detector is performed concurrently with detecting a batch of ions accumulated in the mass analyser using the image current detection.

The ion current or charge may be measured and integrated using the independent detector for a pre-set period (integration period) to obtain a measurement of the total ion charge (or content), e.g. the same period as the injection period for the previous batch of ions accumulated in the injection device (or mass analyser), or another pre-set integration period, or until another criteria is satisfied, e.g. until an integrated measurement of the ion current has reached a pre-set limit.

In one preferred arrangement, the ions may be transmitted to the independent detector as pulses, rather than continuously. The charge of the pulses measured by the independent detector is then integrated. In one such arrangement the injection device, such as a C-trap, may transmit ions to the independent detector not in a continuous but in a pulsed manner. Thus, the injection device is preferably operable to pulse ions to the mass analyser and the independent detector at different times. Although resulting in a longer measurement time for the same signal-to-noise ratio, pulsed detection allows scanning simultaneously of other devices of the instrument, such as RF on upstream devices such as lenses, multipole ion guides or multipole mass filters. It may also allow imitation of any storage-related effects in the injection device such as a C-trap (e.g. decomposition of unwanted clusters).

The control arrangement preferably comprises a computer for controlling the operation of the ion injection device and other components of the spectrometer. For example, the control arrangement may control the ion filling time of the injection device to avoid overloading the injection device, especially where the injection device is an ion trap and the injection time and/or number of ion pulses is used to accumulate the batch of ions in the trap for subsequent injection into the mass analyser.

The ions are typically generated in an ion source from a sample, which may be any suitable ion source, for example, electrospray, MALDI, API, plasma sources, electron ionisation, chemical ionisation etc. More than one ion source may be used. The ions may be any suitable type of ions to be analysed, e.g. small and large organic molecules, biomolecules, DNA, RNA, proteins, peptides, fragments thereof and the like. The ions are typically transmitted to an injection device for injecting ions into the mass analyser.

The injection device may comprise an ion storage device such as an ion trap, preferably a linear ion trap and especially a curved linear ion trap (C-trap). The ion trap may be used for cooling the ions prior to injection into the mass analyser. The injection device preferably is configured for pulsed extraction of ions from the injection device, i.e. to the mass analyser. An example of a suitable ion injection device in the case of injection into an electrostatic orbital trap mass analyser is a curved linear trap (C-trap), as described for example in WO 2008/081334. Thus, the method preferably comprises generating ions in an ion source, transmitting the ions to an injection device and injecting the ions, preferably as a pulse, to the mass analyser, thereby to accumulate a batch of ions in the mass analyser. The injection device preferably has an axis and is operable to eject ions from the injection device orthogonally to the axis to the mass analyser or eject ions axially from the injection device to the independent detector.

The independent detector herein means a detector which is independent of the mass analyser, i.e. the detector is located outside of the mass analyser and as such it is independent from the mass analyser and its image current detection. The independent detector is preferably an absolute ion detector. The independent detector is preferably a charge measuring device. The charge measuring device preferably provides an absolute ion number measurement. The charge measuring device preferably comprises an electrometer. Whilst use of a single independent detector may be described herein, it will be understood that a plurality of independent detectors may be used. For example, whilst use of a single electrometer may be described, it will be understood that a plurality of electrometers may be used. An electrometer has an adequate long term stability and linearity for use as an absolute ion detector. The electrometer can be any device for measuring the charge of ions in a mass spectrometer. The electrometer may comprise, for example, an ion collector such as a collector plate, or a faraday cup, or other like means to collect ions, connected to a high-gain charge sensitive amplifier, preferably with a gain of about $10^{11}$ V/Coulomb or higher. The electrometer may comprise a generator of secondary electrons. Further suitable types of electrometer include dynode, secondary electron multiplier (SEM), channeltron SEM, microchannel and microball SEM, charge-coupled device, charge-injection device, avalanche diode, SEM with conversion into photons followed by photomultiplier, etc. The electrometer preferably can measure ion currents down to 1 pA.

Preferably, the independent detector is located downstream of an injection device for injecting ions into the mass analyser. The independent detector is preferably located on an axis along which the ions may be transmitted through the injection device thereby to reach the charge measuring device. Thus the ions may be transmitted through the injection device along the axis to reach the independent detector when required. The independent detector is preferably located at the end of an axis along which the ions may be transmitted.

The axis is preferably an axis in the direction of which the injection device is elongated. The injection device in such embodiments is preferably an ion trap, especially a linear trap and most especially a curved linear ion trap, through which ions may be transmitted axially when required to the independent detector and from which ions may be extracted orthogonally when required to the mass analyser. Such operation of an ion trap between modes of axial and orthogonal transmission is known in the art.

Alternatively, the independent detector may be located off-axis, that is off the axis along which the ions may be transmitted through the injection device. In that case, the ions may be directed (e.g. deflected) off-axis by ion optics to reach the independent detector when required. The independent detector, or at least the deflecting ion optics, in such embodiments (and indeed some other embodiments) may be located upstream of the injection device.

In certain embodiments, the independent detector may be located downstream of a collision cell, which in turn is downstream of an injection device for injecting ions into the mass analyser.

The apparatus may comprise one or more further ion optical devices, ion traps and/or mass selectors upstream or downstream of the injection device. For example, the apparatus advantageously may comprise a quadrupole or multipole mass selector or filter upstream of the injection device for mass selecting the ions which are transmitted to the injection device. Thus, when required, only ions of a limited range of mass-to-charge ratio (m/z) may be transmitted to the injection device for subsequent detection in the mass analyser. The apparatus advantageously may comprise a collision cell, preferably downstream of the injection device. The collision cell may be for processing the ions, e.g. by fragmenting the ions by collisions with a collision gas in the collision cell. After processing of ions in the collision cell, the ions may be returned upstream to the injection device for injection of the processed ions to the mass analyser.

BRIEF DESCRIPTION OF THE FIGURES

In order to more fully understand the invention, various embodiments will now be described in more detail by way of examples with reference to the accompanying Figures in which.

DETAILED DESCRIPTION OF ILLUSTRATIVE EMBODIMENTS

Figure 1:
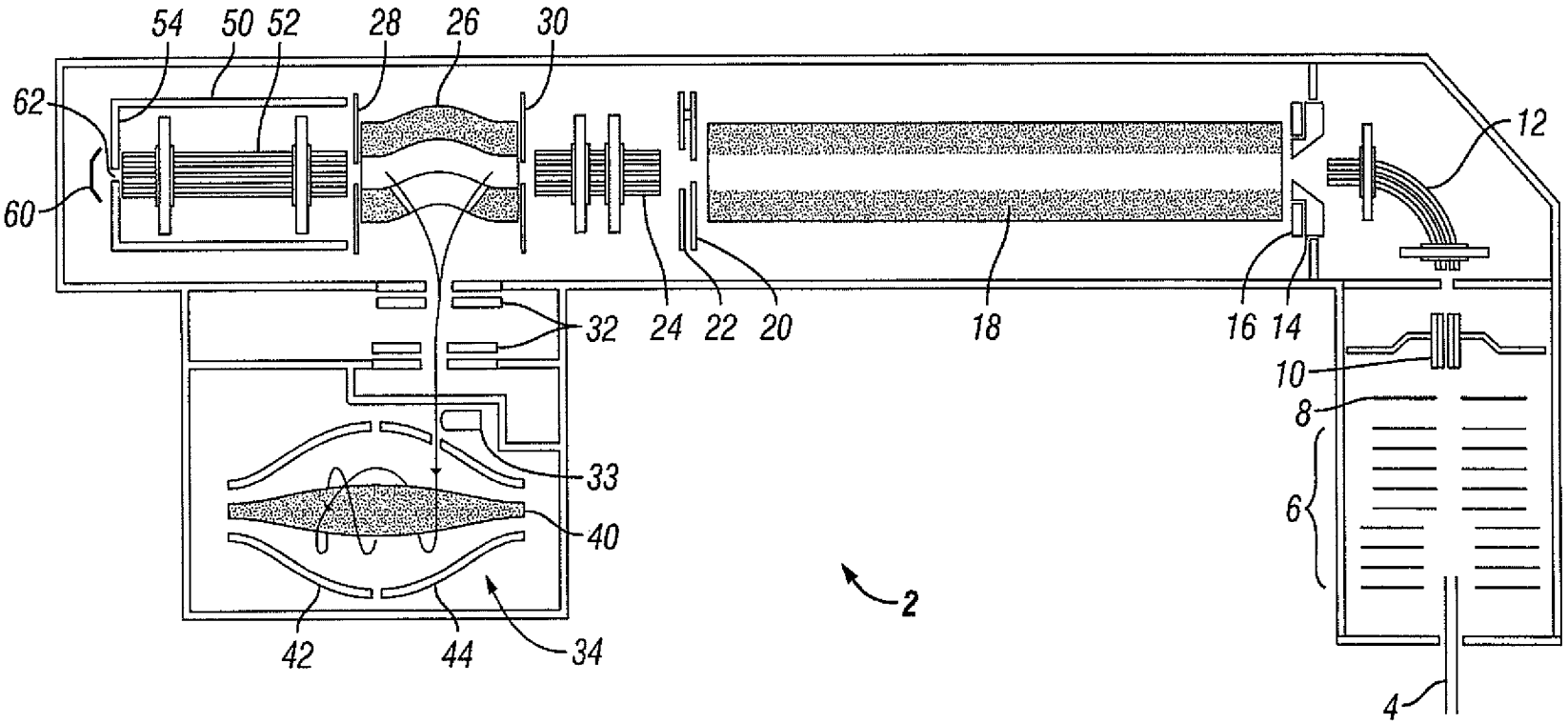
FIG. 1 shows schematically an embodiment of a mass spectrometer for carrying out the method of the present invention.

Referring to FIG. 1, a mass spectrometer 2 is shown in which ions are generated from a sample in an ion source (not shown), which may be a conventional ion source such as an electrospray. Ions may be generated as a continuous stream in the ion source as in electrospray, or in a pulsed manner as in a MALDI source. The sample which is ionised in the ion source may come from an interfaced instrument such as a liquid chromatograph (not shown). The ions pass through a heated capillary 4 (typically held at 320° C.), are transferred by an RF only S-lens 6 (RF amplitude 0-350 Vpp, being set mass dependent), and pass the S-lens exit lens 8 (typically held at 25V). The ions in the ion beam are next transmitted through an injection flatapole 10 and a bent flatapole 12 which are RF only devices to transmit the ions, the RF amplitude being set mass dependent. The ions then pass through a pair of lenses (both mass dependent, with inner lens 14 typically at about 4.5V, and outer lens 16 typically at about −100V) and enter a mass resolving quadrupole 18.

The quadrupole 18 DC offset is typically 4.5 V. The differential RF and DC voltages of the quadrupole 18 are controlled to either transmit ions (RF only mode) or select ions of particular m/z for transmission by applying RF and DC according to the Mathieu stability diagram. It will be appreciated that, in other embodiments, instead of the mass resolving quadrupole 18, an RF only quadrupole or multipole may be used as an ion guide but the spectrometer would lack the capability of mass selection before analysis. In still other embodiments, an alternative mass resolving device may be employed instead of quadrupole 18, such as a linear ion trap, magnetic sector or a time-of-flight analyser. Such a mass resolving device could be used for mass selection and/or ion fragmentation. Turning back to the shown embodiment, the ion beam which is transmitted through quadrupole 18 exits from the quadrupole through a quadrupole exit lens 20 (typically held at −35 to 0V, the voltage being set mass dependent) and is switched on and off by a split lens 22. Then the ions are transferred through a transfer multipole 24 (RF only, RF amplitude being set mass dependent) and collected in a curved linear ion trap (C-trap) 26. The C-trap is elongated in an axial direction (thereby defining a trap axis) in which the ions enter the trap. Voltage on the C-Trap exit lens 28 can be set in such a way that ions cannot pass and thereby get stored within the C-trap 26. Similarly, after the desired ion fill time (or number of ion pulses e.g. with MALDI) into the C-trap has been reached, the voltage on C-trap entrance lens 30 is set such that ions cannot pass out of the trap and ions are no longer injected into the C-trap. More accurate gating of the incoming ion beam is provided by the split lens 22. The ions are trapped radially in the C-trap by applying RF voltage to the curved rods of the trap in a known manner.

Ions which are stored within the C-trap 26 can be ejected orthogonally to the axis of the trap (orthogonal ejection) by pulsing DC to the C-trap in order for the ions to be injected, in this case via Z-lens 32, and deflector 33 into a mass analyser 34, which in this case is an electrostatic orbital trap, and more specifically an Orbitrap™ FT mass analyser made by Thermo Fisher Scientific. The orbital trap 34 comprises an inner electrode 40 elongated along the orbital trap axis and a split pair of outer electrodes 42, 44 which surround the inner electrode 40 and define therebetween a trapping volume in which ions are trapped and oscillate by orbiting around the inner electrode 40 to which is applied a trapping voltage whilst oscillating back and forth along the axis of the trap. The pair of outer electrodes 42, 44 function as detection electrodes to detect an image current induced by the oscillation of the ions in the trapping volume and thereby provide a detected signal. The outer electrodes 42, 44 thus constitute a first detector of the system. The outer electrodes 42, 44 typically function as differential pair of detection electrodes and are coupled to respective inputs of a differential amplifier (not shown), which in turn forms part of a digital data acquisition system (not shown) to receive the detected signal. The detected signal can be processed using Fourier transformation to obtain a mass spectrum.

The mass spectrometer 2 further comprises a collision or reaction cell 50 downstream of the C-trap 26. Ions collected in the C-trap 26 can be ejected orthogonally as a pulse to the mass analyser 34 without entering the collision or reaction cell 52 or the ions can be transmitted axially to the collision or reaction cell for processing before returning the processed ions to the C-trap for subsequent orthogonal ejection to the mass analyser. The C-trap exit lens 28 in that case is set to allow ions to enter the collision or reaction cell 50 and ions can be injected into the collision or reaction cell by an appropriate voltage gradient between the C-trap and the collision or reaction cell (e.g. the collision or reaction cell may be offset to negative potential for positive ions). The collision energy can be controlled by this voltage gradient. The collision or reaction cell 50 comprises a multipole 52 to contain the ions. The collision or reaction cell 50, for example, may be pressurised with a collision gas so as to enable fragmentation (collision induced dissociation) of ions therein, or may contain a source of reactive ions for electron transfer dissociation (ETD) of ions therein. The ions are prevented from leaving the collision or reaction cell 50 axially by setting an appropriate voltage to a collision cell exit lens 54. The C-trap exit lens 28 at the other end of the collision or reaction cell 50 also acts as an entrance lens to the collision or reaction cell 50 and can be set to prevent ions leaving whilst they undergo processing in the collision or reaction cell if need be. In other embodiments, the collision or reaction cell 50 may have its own separate entrance lens. After processing in the collision or reaction cell 50 the potential of the cell 50 may be offset so as to eject ions back into the C-trap (the C-trap exit lens 28 being set to allow the return of the ions to the C-trap) for storage, for example the voltage offset of the cell 50 may be lifted to eject positive ions back to the C-trap. The ions thus stored in the C-trap may then be injected into the mass analyser 34 as described before.

The mass spectrometer 2 further comprises an electrometer 60 which is situated downstream of the collision or reaction cell 50 and can be reached by the ion beam through an aperture 62 in the collisional cell exit lens 54. The electrometer 60 may be either a collector plate or Faraday cup and is connected to a high gain charge sensitive amplifier, typically with a gain of about $10^{11}$ V/Coulomb. It will be appreciated, however, that the electrometer 60 in other embodiments may be another type of charge measuring device. Preferably, the electrometer is of differential type which reduces noise pick-up from other electrical sources nearby. A first input of the electrometer is arranged to receive current or charge from the ion source while another input is arranged to have similar capacitance, dimensions and orientation to the first input but receives no ion current or charge at all. The electrometer 60 thus constitutes a second detector of the system, which is independent of the first detector, namely the image current detection electrodes 42, 44 of the mass analyser 34. In some embodiments the collision or reaction cell 50 may not be present, in which case the electrometer 60 is preferably located downstream of the C-trap behind C-trap exit lens 28.

It will be appreciated that the path of the ion beam through the spectrometer and in the mass analyser is under appropriate evacuated conditions as known in the art, with different levels of vacuum appropriate for different parts of the spectrometer.

The mass spectrometer 2 is under the control of a control unit, such as an appropriately programmed computer (not shown), which controls the operation of various components and, for example, sets the voltages to be applied to the various components and which receives and processes data from various components including the detectors. The computer is configured to use an algorithm in accordance with the present invention to determine the settings (e.g. injection time or number of ion pulses) for the injection of ions into the C-trap for analytical scans in order to achieve the desired ion content (i.e. number of ions) therein which avoids space charge effects whilst optimising the statistics of the collected data from the analytical scan.

Alternatively to the arrangement shown in FIG. 1, the electrometer may be located off-axis, i.e. off the axis along which the ions are transmitted through the C-trap. In that case, the ions may be directed (e.g. deflected) off-axis by ion optics to reach the electrometer when required. The electrometer, or at least the deflecting ion optics, in such embodiments may be located upstream of the C-trap. As an example, one plate of the gating lens 22 could be used for this.

Figure 2:
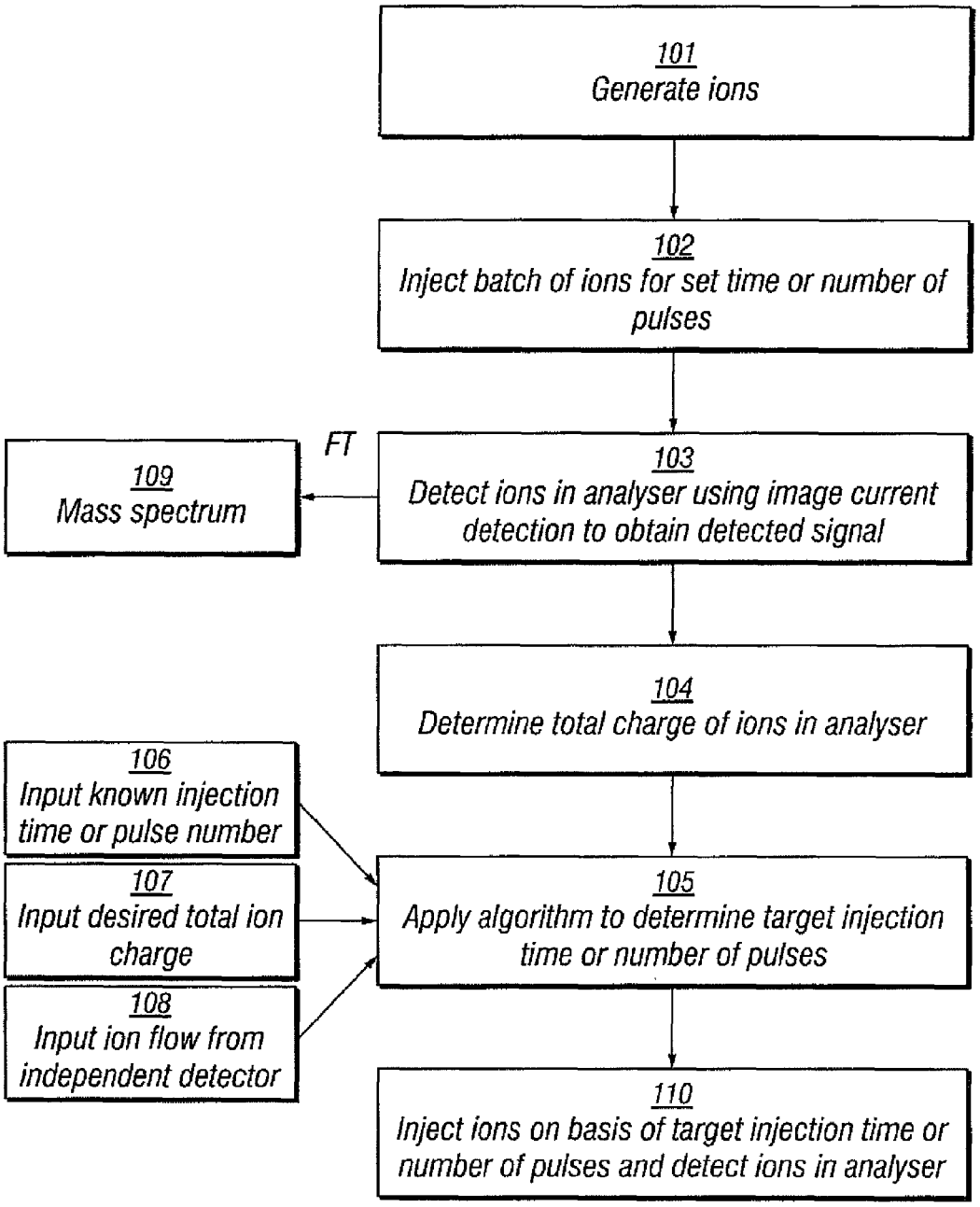
FIG. 2 shows a schematic flow chart of steps in an exemplary method according to the present invention.

Referring to FIG. 2 there is shown a schematic flow chart of steps in an exemplary method according to the present invention, which is hereinafter described in more detail and which may be carried out using the spectrometer shown in FIG. 1. In a step 101, ions are generated in the ion source. The generated ions are then transmitted, optionally with mass selection using the quadrupole 18 to select ions of a desired mass range, to the C-trap 26 where they are stored in step 102. The C-trap is typically filled with ions for a set time where a continuous ion source is used, such as an electrospray, or with a set number of ion pulses where a pulsed ion source is used, such as a MALDI source, i.e. the parameter $IT_{Pro}$ in the equations above. The filling conditions for the C-trap are set and controlled by the spectrometer's control arrangement.

The stored ions are ejected from the C-trap 26 and injected as a pulse into the Orbitrap™ mass analyser 34. An Orbitrap™ mass analyser typically has a greater space charge capacity than the C-trap. Filling of the C-trap is therefore to be controlled to avoid overfilling the C-trap leading to space charge effects as described in more detail below.

In step 103, the batch of ions accumulated in the mass analyser is detected using image current detection, i.e. on detection electrodes 42, 44, to obtain a detected signal, which is fed to the computer of the control arrangement. The detected signal may be used to produce a mass spectrum using Fourier transformation in a step 109, and this is done in the case where the image current detection in step 103 constitutes an analytical scan. Where the image current detection in step 103 is merely conducted for a short pre-scan then a mass spectrum may not be required from it.

In step 104, the total charge of the ions in the mass analyser is determined from the detected signal obtained in step 103 by the computer, i.e. the parameter $TIC_{Pre}$ in the equations above is determined. In a preferred embodiment, this is done by summing together all signals above a (S/N) threshold and converting to charge using a conversion coefficient (determined during calibration or set a priori on the basis of properties of the preamplifier). In step 105 the computer uses the determined total ion charge in an algorithm to calculate a target injection time or number of pulses for a subsequent batch of ions into the C-trap thereafter to be accumulated in the mass analyser, i.e. the parameter $IT_{Target}$ in the equations above. The algorithm uses the thus determined total ion charge for the current batch of ions from step 104, $TIC_{Pre}$, and the known set injection time or number of pulses into the C-trap that was used in step 102 for the current batch of ions (input 106), $IT_{Pre}$, in order to determine settings for the C-trap such as a target injection time or target number of pulses into the C-trap for a subsequent batch of ions to be used for an analytical scan, $IT_{Target}$. The settings are determined on the basis of achieving a desired or target total ion charge (hence number of ions) in the C-trap which avoids space charge effects (input 107), i.e. the parameter $TIC_{Target}$ in the equations above. The algorithm also uses an information input 108 which contains a measurement of integrated ion current (ion charge) from the independent detector, electrometer 60, i.e. the parameter $I_{Ind}$. The measurement of integrated ion current from the independent electrometer adjusts the total ion charge determined from the image current detection by scaling it to the absolute total ion charge (integrated ion current) measured by the electrometer, i.e. by using the coefficient C in the equation above. The measurement of ion current or charge by the independent electrometer may be carried out periodically and typically less frequently than analytical scans. The measurement of ion current or charge by the independent electrometer is preferably performed during an analytical scan. For the electrometer measurement, e.g. after ions have been injected into the analyser for an analytical scan, the C-trap and collision cell 50 are set for transmission so that ions from the ion source are directed onto the electrometer 60 and an integrated ion current (ion charge) measured for a set time period or number of pulses (integrating period), e.g. the same period or number of pulses as the known injection time for the ion batch used to determine the total ion charge by image current detection. However, a different integrating period may be used as long as it is known, so that an integrated ion current (ion charge) corresponding to the known injection time or number of pulses into the C-trap can be obtained. The integrating period is typically of the order of about 10 to 200 ms, preferably 20 to 100 ms. The absolute total ion charge for the ion batch corresponding to the integrated ion current (ion charge) is thereby obtained from the electrometer measurement for input 108 in the algorithm.

The method then uses the target injection time or number of pulses determined in step 105 for controlling injection of a subsequent batch of ions into the C-trap in step 110 thereby to store a desired or target number of ions in the C-trap which avoids space charge effects but optimizes data collection. Subsequently, the stored desired or target number of ions is ejected from the C-trap and injected into the mass analyser for detection in an analytical scan.

In one preferred embodiment, the C-trap could transmit ions to the electrometer not in a continuous but in a pulsed manner. Although resulting in a longer measurement time for the same signal-to-noise ratio, it allows scanning simultaneously other devices of the instrument, such as RF on lens 6 or multipole 12 or quadrupole 18. It also could allow imitating any storage-related effects in the C-trap (e.g. decomposition of unwanted clusters).

It will be appreciated that in the method batches of ions may be fragmented in the collision or reaction cell 50, in the manner described herein, as part of $MS^2$ or $MS^n$ experiments.

It will be appreciated that the spectrometer described with reference to FIG. 1 and the method described with reference to FIG. 2 are merely examples of implementations of the present invention. Numerous variations to the foregoing embodiments of the invention can be made while still falling within the scope of the invention.

The electrometer 60 may also be useful in the following ways:

1. For optimization and characterization of the spectrometer prior to the injection device (e.g. C-trap), especially in combination with the mass filter 18, wherein the ion current or charge from the ion source is used as the criterion for optimisation. For example, in the shown embodiment, the C-trap 26 and the collision or reaction cell 50 can be set for axial transmission so that the ions are transmitted straight through the system to the electrometer 60 in order for the ion current or charge of the ion beam to be measured. The ion current or charge could, for example, be monitored using the electrometer 60 whilst optimising operating parameters of various components of the mass spectrometer, especially upstream of the C-trap.

2. For optimization and characterization of the spectrometer from the injection device (e.g. C-trap) to the mass analyser (e.g. Orbitrap™) especially using well-defined calibration mixtures. The ratio between the measured ion current or charge (using the electrometer) from the ion source to the detected signal-to-noise ratios in the mass analyser Orbitrap analyzer can be used as the criterion for optimising and characterising. Also, the C-trap could transmit ions to the electrometer not in a continuous but in a pulsed manner, thus providing an indication of any storage-related effects such as fragmentation, ion losses or discriminations which might take place in a case of fault.

3. For estimation of the "fractality" of complex mixtures. "Fractality" is described as the property of the mixture to have a multiplicity of smaller peaks in vicinity of almost every intense mass peak, with each of the smaller peaks having in their turn a multitude of smaller peaks nearby. Such mixtures produce complicated interference effects in FTMS and therefore cannot be reliably quantified from FTMS detection alone. As the result, compensation of space charge effects cannot be carried out reliably thus resulting in the loss of external mass accuracy of the instrument. Fractality could be measured as a ratio of the total ion current or charge on electrometer and total ion current or charge as detected by image current detection. The higher the ratio, the more important is that factor for mass accuracy of the instrument.

4. For measuring the absolute ion numbers of mass-selected ions stored in the injection device (e.g. C-trap) and/or the collision or reaction cell for diagnostic purposes.

The above methods may be implemented by means of a mass spectrometer comprising a mass analyser and an independent detector such as an electrometer.

Figure 3:
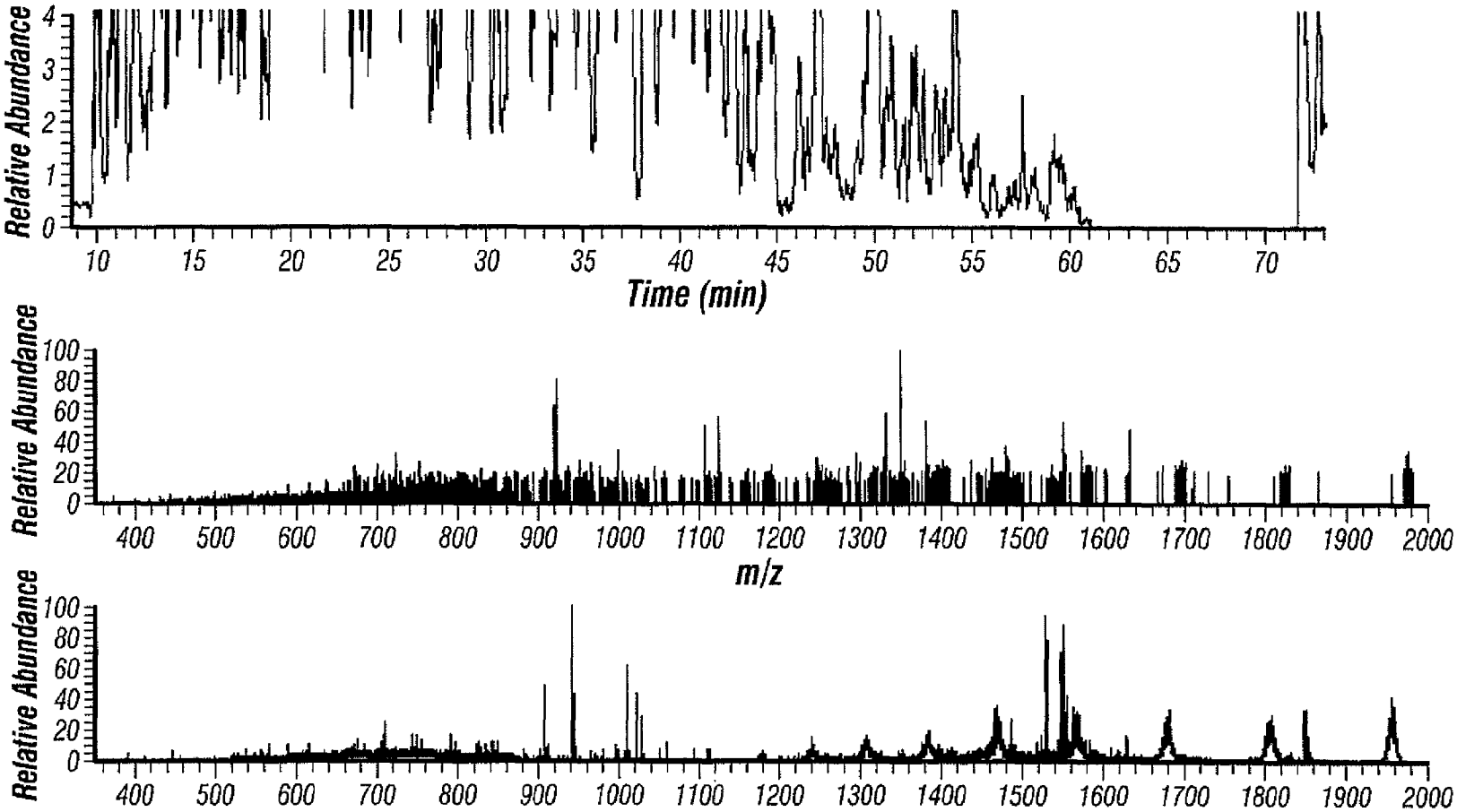
FIG. 3 shows an LC-MS mass chromatogram of a HeLa sample obtained using a prior art method of automatic gain control (AGC).

As described above, the present invention can enable full utilization of the analytical performance and space charge capacity of an Orbitrap system. In order to achieve this, in a typical Orbitrap instrument, the number of ions injected to the C-Trap needs to be controlled. The measurement of the ion current was previously either done via a dedicated AGC-prescan, which records a very short transient, or it could be done by using so-called Scan-to-Scan AGC which uses the first short section of the previous analytical scan. The resulting ion current from this short transient acquisition may be used to calculate the injection time for the next analytical scan. In some rare cases, however, the number of ions can be underestimated because of the low resolution and the lower signal response of this short transient acquisition. This is especially true for multiply charged ions and dense peaks below the noise threshold. To demonstrate this effect, an experiment was performed with the maximum inject time set untypically high. FIG. 3 shows a 60 minute gradient LC chromatogram of HeLa sample containing partially digested proteins and including the column wash part. Close to the end of the run, at retention times between 62 and 72 minutes, the signal is suppressed. A single spectrum from this section (middle trace) shows multiply charged species that won't be resolved in the short AGC-prescan and therefore will be underestimated. The second spectrum (lower trace) shows the average of three minutes, here partially digested proteins become visible showing ions that also cannot be seen by the short acquisition of the AGC-prescan which leads to further underestimation of the ion current. In this case the inject time for the analytical scan will be too long causing overfilling of the C-Trap, which leads to the suppression effect. A valid workaround formerly was to reduce the AGC target and to set the maximum inject time carefully to a dedicated level for each sample class.

Figure 4:
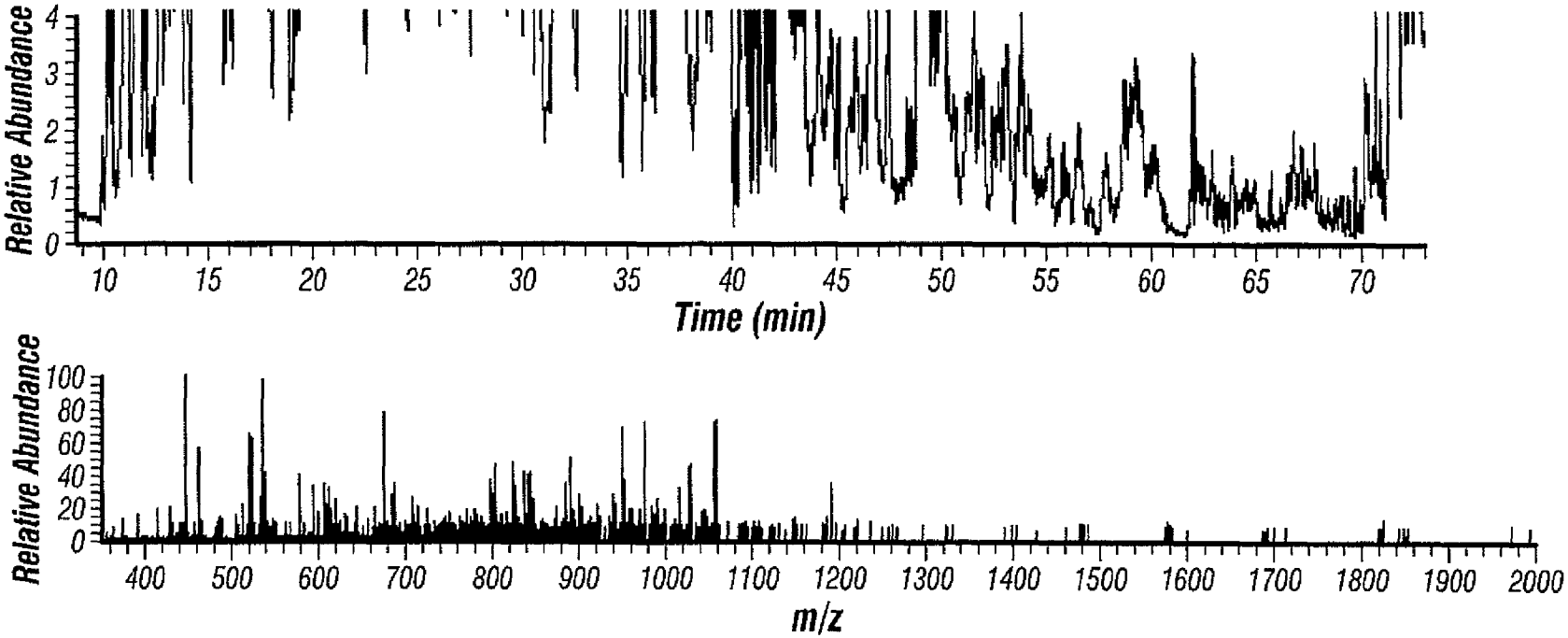
FIG. 4 shows an LC-MS mass chromatogram of a HeLa sample obtained using the method of the present invention.

To improve the analytical robustness of the AGC control scheme, a C-Trap charge detection using the method of the present invention and an apparatus similar to that shown in FIG. 1 was used to monitor the AGC results every 5 to 10 seconds. In this method, during LC runs, the charge detection operation takes place in parallel to Orbitrap acquisition (i.e. concurrently). While the analytical scan in the Orbitrap was still being acquired, a few C-Trap injections were ejected to the charge collector (electrometer) to measure the C-Trap charge. From this the total ion current (TIC) was calculated and compared to the TIC observed by the short transient AGC-scan. If necessary, the injection time was regulated down to prevent the C-Trap from overfilling. This measure avoids the described signal suppression. Using the C-Trap charge detection the HeLa run was repeated and its chromatogram is shown in FIG. 4. To emphasize the effect by getting closer to the upper C-Trap space charge limit, the AGC target was set to 3e6 for this experiment. Now the suppression during the column wash process is eliminated. The spectrum shows now several analyte peaks which can be used for further confirmation.

Herein the term mass means mass or mass-to charge ratio (m/z). It will also be appreciated that image current detection detects frequencies which correspond to masses or m/z values. Accordingly, references herein to mass, mass spectrum and the like also encompass the feature in frequency, which is representative of the mass term.

As used herein, including in the claims, unless the context indicates otherwise, singular forms of the terms herein are to be construed as including the plural form and vice versa. For instance, unless the context indicates otherwise, a singular reference herein including in the claims, such as "a" or "an" means "one or more".

Throughout the description and claims of this specification, the words "comprise", "including", "having" and "contain" and variations of the words, for example "comprising" and "comprises" etc, mean "including but not limited to", and are not intended to (and do not) exclude other components.

It will be appreciated that variations to the foregoing embodiments of the invention can be made while still falling within the scope of the invention. Each feature disclosed in this specification, unless stated otherwise, may be replaced by alternative features serving the same, equivalent or similar purpose. Thus, unless stated otherwise, each feature disclosed is one example only of a generic series of equivalent or similar features.

The use of any and all examples, or exemplary language ("for instance", "such as", "for example" and like language) provided herein, is intended merely to better illustrate the invention and does not indicate a limitation on the scope of the invention unless otherwise claimed. No language in the specification should be construed as indicating any non-claimed element as essential to the practice of the invention.

Any steps described in this specification may be performed in any order or simultaneously unless stated or the context requires otherwise.

All of the features disclosed in this specification may be combined in any combination, except combinations where at least some of such features and/or steps are mutually exclusive. In particular, the preferred features of the invention are applicable to all aspects of the invention and may be used in any combination. Likewise, features described in non-essential combinations may be used separately (not in combination).

The invention claimed is:

1. A method of controlling the accumulation of ions in a mass spectrometer comprising:

measuring an ion current or charge using a charge measuring device located downstream of an ion injection device at the end of an axis along which the ions are axially transmitted through the ion injection device such that the ions are transmitted through the injection device to reach the charge measuring device, followed by using the measured ion current or charge for adjusting the charge of a batch of ions subsequently injected from the ion injection device into a mass analyser located on a different axis and detected in the mass analyser using image current detection;

wherein the frequency of measurement of ion current or charge using the charge measuring device is less than the frequency of obtaining detected signals from batches of ions in the mass analyser and wherein, between measurements of ion current or charge using the charge measuring device, measurements of total ion content are obtained using image current detection from ions injected into the mass analyser and used to control ion injection times for accumulating ions in the mass analyser.

2. A method as in claim 1 wherein the axis is in the direction of elongation of the injection device.

3. A method as in claim 2 wherein the ions are ejected to the mass analyser orthogonally from the injection device.

4. A method as in claim 1 wherein the charge measuring device is located downstream of a collision cell which is downstream of the injection device.

5. A method as in claim 1 wherein a multipole mass selector is provided upstream of the injection device.

6. A method as in claim 1 wherein the charge measuring device comprises one of: a collector plate, a faraday cup, a dynode, a secondary electron multiplier (SEM), a channeltron SEM, a microchannel SEM, a microball SEM, a charge-coupled device, a charge-injection device, an avalanche diode, an SEM with conversion into photons followed by a photomultiplier.

7. A method as in claim 1 wherein the mass analyser is a Fourier transform mass analyser.

8. A method as in claim 1 wherein the mass analyser is selected from the group of: an FT-ICR cell, an electrostatic trap, an electrostatic orbital trap and an RF ion trap.

9. A method as in claim 1 wherein the injection device comprises a linear ion trap.

10. A method as in claim 1 wherein the injection device comprises a curved linear ion trap.

11. A method as in claim 1 wherein the charge measuring device is used every 1 to 10 seconds to measure the ion current or charge.

12. A method as in claim 1 wherein the measurement of ion current or charge using the charge measuring device is performed concurrently with detecting a batch of ions accumulated in the mass analyser using image current detection.

13. A mass spectrometer comprising:

a charge measuring device for measuring an ion current of ions, the charge measuring device located downstream of an ion injection device at the end of an axis along which ions are axially transmitted through the ion injection device such that the ions are transmitted through the injection device to reach the charge measuring device;

a mass analyser located on a different axis and comprising detection electrodes for detecting a signal from a batch of ions accumulated in the analyser using image current detection; and a control arrangement operable to measure an ion current or charge using the charge measuring device and to use the measured ion current or charge to adjust the charge of a batch of ions subsequently injected into the mass analyser from the ion injection device and detected in the mass analyser using image current detection;

wherein the control arrangement is further operable to measure ion current or charge using the charge measuring device less frequently than it obtains detected signals from batches of ions in the mass analyser and wherein, between measurements of ion current or charge using the charge measuring device, the control arrangement is operable to obtain measurements of total ion content using image current detection from ions injected into the mass analyser and to use the measurements of total ion content using image current detection to control ion injection times for accumulating ions in the mass analyser.

14. A mass spectrometer as in claim 13 wherein the axis is in the direction of elongation of the injection device.

15. A mass spectrometer as in claim 13 wherein the injection device is configured to eject ions to the mass analyser orthogonally from the injection device.

16. A mass spectrometer as in claim 13 wherein the charge measuring device is located downstream of a collision cell which is downstream of the injection device.

17. A mass spectrometer as in claim 13 wherein a multipole mass selector is located upstream of the injection device.

18. A mass spectrometer as in claim 13 wherein the charge measuring device comprises one of: a collector plate, a faraday cup, a dynode, a secondary electron multiplier (SEM), a channeltron SEM, a microchannel SEM, a microball SEM, a charge-coupled device, a charge-injection device, an avalanche diode, an SEM with conversion into photons followed by a photomultiplier.

19. A mass spectrometer as in claim 13 wherein the mass analyser is a Fourier transform mass analyser.

20. A mass spectrometer as in claim 13 wherein the mass analyser is selected from the group of: an FT-ICR cell, an electrostatic trap, an electrostatic orbital trap and an RF ion trap.

21. A mass spectrometer as in claim 13 wherein the injection device comprises a linear ion trap.

22. A mass spectrometer as in claim 13 wherein the injection device comprises a curved linear ion trap.

* * * * *